US009091123B2

(12) United States Patent
Gust

(10) Patent No.: US 9,091,123 B2
(45) Date of Patent: Jul. 28, 2015

(54) METHOD AND APPARATUS FOR CREATING A PRESSURE PULSE IN DRILLING FLUID TO VIBRATE A DRILL STRING

(75) Inventor: Tom Gust, Edmonton (CA)

(73) Assignee: Cougar Drilling Solutions Inc., Edmonton, Alberta (CA)

( * ) Notice: Subject to any disclaimer, the term of this patent is extended or adjusted under 35 U.S.C. 154(b) by 760 days.

(21) Appl. No.: 13/364,451

(22) Filed: Feb. 2, 2012

(65) Prior Publication Data

US 2013/0199848 A1 Aug. 8, 2013

(51) Int. Cl.
*E21B 4/02* (2006.01)
*E21B 7/24* (2006.01)

(52) U.S. Cl.
CPC ..... *E21B 7/24* (2013.01)

(58) Field of Classification Search
CPC ..... E21B 4/02; E21B 4/06; E21B 4/10; E21B 7/24
USPC ..... 175/40, 107, 296
See application file for complete search history.

(56) References Cited

U.S. PATENT DOCUMENTS

| | | | | |
|---|---|---|---|---|
| 5,787,052 | A | 7/1998 | Gardner et al. | |
| 6,279,670 | B1 * | 8/2001 | Eddison et al. | 175/107 |
| 6,714,138 | B1 | 3/2004 | Turner et al. | |
| 7,327,634 | B2 | 2/2008 | Perry et al. | |
| 7,405,998 | B2 | 7/2008 | Webb et al. | |
| 7,719,439 | B2 | 5/2010 | Pratt et al. | |

FOREIGN PATENT DOCUMENTS

| | | |
|---|---|---|
| CA | 1165854 | 11/1980 |
| CA | 2546398 | 5/2006 |
| CA | 2621855 | 9/2007 |
| CA | 2651154 | 11/2007 |
| CA | 2663703 | 4/2008 |

* cited by examiner

*Primary Examiner* — Catherine Loikith
(74) *Attorney, Agent, or Firm* — Bennett Jones LLP

(57) ABSTRACT

A pressure pulse generating method and apparatus for use with a drill string includes a top and bottom subs for attaching the apparatus within the drill string; a rotor/stator; a drive assembly; and a nozzle sub which includes a nozzle assembly comprising a nozzle holder and a replaceable nozzle; and a nozzle housing having pulse openings. The nozzle holder has fluid ports which periodically align with the pulse openings as the nozzle holder rotates within the nozzle housing to achieve a desired pulse amplitude, frequency and waveform.

24 Claims, 3 Drawing Sheets

METHOD AND APPARATUS FOR CREATING A PRESSURE PULSE IN DRILLING FLUID TO VIBRATE A DRILL STRING

FIELD OF THE INVENTION

The present invention relates to down hole drilling operations, and in particular to an apparatus and method for creating a pressure pulse in drilling fluid in the down hole environment to vibrate the drill string.

BACKGROUND OF THE INVENTION

Directional drilling has become a standard drilling procedure whereby formations located significant lateral distances from surface wells are targeted by drilling to a depth and then also laterally. A mud motor, powered by the pressurized drilling mud injected into the drill string at the surface, is located downhole adjacent to the bit and rotates the bit to advance the bore hole. Unlike conventional drilling, in lateral directional drilling operations the drill string itself does not rotate, but rather just the bit powered by the mud motor.

During the lateral phase of directional drilling operations, a sizable portion of the drill string is in direct contact with the borehole. This causes significant frictional resistance, particularly when the drill string is not rotating. Further, when drilling operations are halted, the drill string tends to sink into mud in the bore hole, sticking and making it difficult to advance the drill string into the bore hole when drilling operations are recommenced. Overcoming the friction between the borehole and the drill string can greatly impede the ability of the driller to provide the optimal amount of weight to the drill bit to achieve the maximum penetrative rate. Frequently, the application of force to overcome the friction results in excessive weight being placed on the bit which can damage the downhole drilling equipment and reduce penetrative efficiency.

What is required is an apparatus and method of agitating or vibrating the drill string to overcome the friction arising between the drill string and the bore hole in the lateral section of directionally drilled well bore. The apparatus needs to be robust, relatively simple and capable of being inserted into the downhole environment. Such apparatus and method needs to mitigate the frictional problems of directional drilling and will preferably facilitate greater rates of penetration.

It is well known in the art to create pressure pulses in the drilling fluid for the purpose of telemetric tracking of the drill bit and the associated drill string to accurately track lateral drilling progress. However, the use of a pressure pulse to vibrate the drill string to overcome frictional resistance during directional drilling is relatively unknown.

SUMMARY OF THE INVENTION

The present invention is directed to an apparatus and a method for creating a pressure pulse in drilling fluid in the downhole environment to vibrate the drill string. The pressure pulse is created in drilling fluid passing through a drill string to a mud motor to drill bit. The pressure pulse acts on the drill string to cause vibration and agitation of the drill string, which may mitigate frictional resistance between the drill string and the well bore.

Accordingly, in one aspect, the invention comprises a pressure pulse generating apparatus for use with a drill string, the apparatus comprising:

a) a top sub and a bottom sub for attaching the apparatus within the drill string;

b) a rotor/stator;

c) a drive assembly; and d) a nozzle sub adapted to attach to the drive assembly and to house:

i) a nozzle assembly comprising a nozzle holder being rotatably mounted within the nozzle sub and having a cylindrical nozzle external bearing surface which defines at least one fluid port, and a replaceable nozzle for controlling the pressure drop across the nozzle; and ii) a nozzle housing having a cylindrical internal bearing surface, defining at least one pulse opening, which mates with the nozzle holder external bearing surface, wherein the at least one nozzle fluid port periodically aligns with the at least one pulse opening as the nozzle holder rotates within the nozzle housing.

In one embodiment, the top sub is configured for coupling to the drill string at a first end and to the rotor/stator at a second end and defines a bore between the first and second ends.

In one embodiment, the rotor and stator comprises a 1:2, 3:4, 4:5, 5:6, 7:8 or 9:10 lobe combination.

In one embodiment, the drive assembly comprises a drive shaft having a first end coupled to the rotor/stator and a second end coupled to the nozzle assembly. In one embodiment, the drive shaft is coupled and sealed to the rotor/stator, and to the nozzle assembly using upper and lower adapters.

In one embodiment, the nozzle sub has a first end adapted to attach to the drive sub, a second end adapted to attach to the bottom sub, and a central bore extending between the first and second ends.

In one embodiment, the bottom sub has a first end to attach to the nozzle sub, a second end to attach to the drill string, and a central bore extending between the first and second ends.

In one embodiment, the nozzle holder and nozzle are axially aligned to define an uninterrupted flow path for drilling fluid therethrough. In one embodiment, the nozzle is conical-shaped. In one embodiment, the nozzle holder comprises at least one groove on its outer diameter for receiving at least one seal for sealing the nozzle holder against the nozzle housing.

In one embodiment, the nozzle housing defines a shoulder adapted to abut a cylindrical bearing support member mounted within the nozzle sub. In one embodiment, the nozzle housing comprises a groove for receiving a seal.

In one embodiment, the apparatus further comprises a removable retaining ring for securing the nozzle.

In one embodiment, the fluid ports and pulse openings are positioned in a radial direction with respect to the axis of the apparatus and fluid flow. In one embodiment, the fluid ports and pulse openings are both elongated in the axial direction and have substantially similar shapes and dimensions. In one embodiment, there are two opposing nozzle fluid ports. In one embodiment, there are two opposing pulse openings.

In one embodiment, the lower adapter and the nozzle holder are secured in sealing relation by a nozzle nut. In one embodiment, a seal is provided for sealing the lower adapter and the nozzle holder within the nozzle nut.

In one embodiment, the apparatus further comprises a circumferential bearing assembly for supporting the drive assembly and the nozzle holder. In one embodiment, the bearing assembly comprises a roller bearing.

In another aspect, the invention comprises a method of axially vibrating a drill string, comprising the step of inserting the above apparatus in the drill string, pumping drilling fluid through the drill string and creating pressure pulse waves of a desired frequency, amplitude and waveform. In one embodiment, creating pressure pulse waves of the desired frequency, amplitude and waveform comprises varying the number, size or shape of the fluid ports and pulse openings, or the size of the nozzle.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for a pressure pulse generating apparatus for use in a drill string. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

As used herein, the term "axial" means a direction substantially parallel to the longitudinal axis of the apparatus. The term "radial" means a direction substantially transverse to the longitudinal axis of the apparatus. The terms "top" and "bottom" or "upper" and "lower" refer to the orientation of the apparatus as shown in FIG. 1, where the top or upper end is closer to the surface or the vertical section of the wellbore, and the bottom or lower end is closer to the drill bit.

Figure 1:
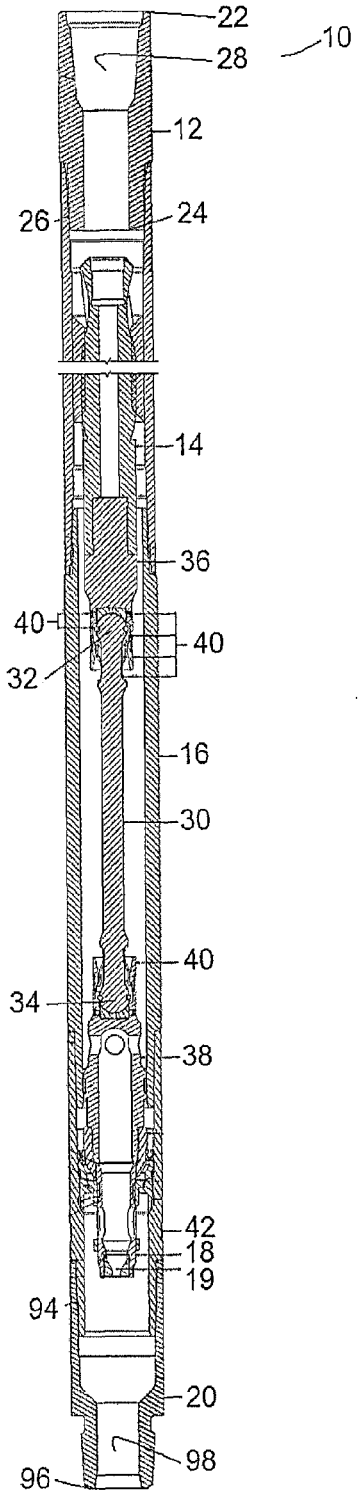
FIG. 1 is a cross-sectional view of one embodiment of the present invention.

The apparatus (10) is shown generally in FIG. 1 to include, sequentially from the top to the bottom, a top sub (12); a power section (14); a drive assembly (16); a nozzle assembly comprising a nozzle holder (18) and a replaceable nozzle (19); and a bottom sub (20). The apparatus (10) of the present invention is connected within the drill string at a suitable position above a drill bit (not shown).

The top sub (12) is configured for coupling to a drill string (not shown) at a first end (22) and to the power section (14) at a second end (24) using suitable connection means (26) as are well known in the art. The top sub (12) defines a bore (28) through which drilling fluid passes during operation.

The power section (14) comprises a helical-shaped rotor and stator. The rotor is typically formed of steel and is either chrome plated or coated for wear resistance. The stator is a heat-treated steel tube lined with a helical-shaped elastomeric insert. The rotor has one less lobe than the stator and when the two are assembled, a series of cavities is formed along the helical curve of the power section (14). Each of the cavities is sealed from adjacent cavities by seal lines which are formed along the contact line between the rotor and stator. The centerline of the rotor is offset from the center of the stator by a fixed value known as the eccentricity of the power section (14). As the rotor turns inside the stator, its center moves in a circular motion about the center of the stator. Rotation of the rotor about its own axis occurs simultaneously but is opposite to the rotation of the rotor center about the stator center. Drilling fluid pumped through the top sub (12) fills the first set of open cavities, with the pressure differential across two adjacent cavities forcing the rotor to turn. Simultaneously, adjacent cavities are opened, allowing the fluid to flow progressively down the length of the power section (14). Opening and closing of the cavities occurs in a continuous, pulsationless manner, causing the rotor to rotate and effectively converting fluid hydraulic energy into mechanical energy. In the apparatus (10) of the present invention, the power section (14) can conveniently utilize any given lobe combination of rotor/stator including, but not limited to, 1:2, 3:4, 4:5, 5:6, 7:8 and 9:10 rotor/stator designs.

The drive assembly (16) comprises a drive shaft (30) having a first end (32) coupled to the rotor of the power section (14) and a second end (34) coupled to the nozzle holder (18). It will be appreciated by those skilled in the art that additional coupling configured to attach various components may be utilized. The drive shaft (30) is coupled and sealed to the rotor and stator (14), and to the nozzle holder (18) using upper and lower adapters (36, 38), respectively. Suitable coupling and sealing assemblies (40) may include, but are not limited to, inserts, bearings, dry seals, split ring assemblies, boot rings, and seal boots as are well known in the art. A nozzle sub (42) has a first end (44) and a second end (46). The first end (44) is adapted to attach to the drive assembly (16), while the second end (46) is adapted to attach to the bottom sub (20) in a conventional manner. The sub (42) has a central bore (48) extending from the first end (44) to the second end (46) to accommodate the components described herein.

Figure 2:
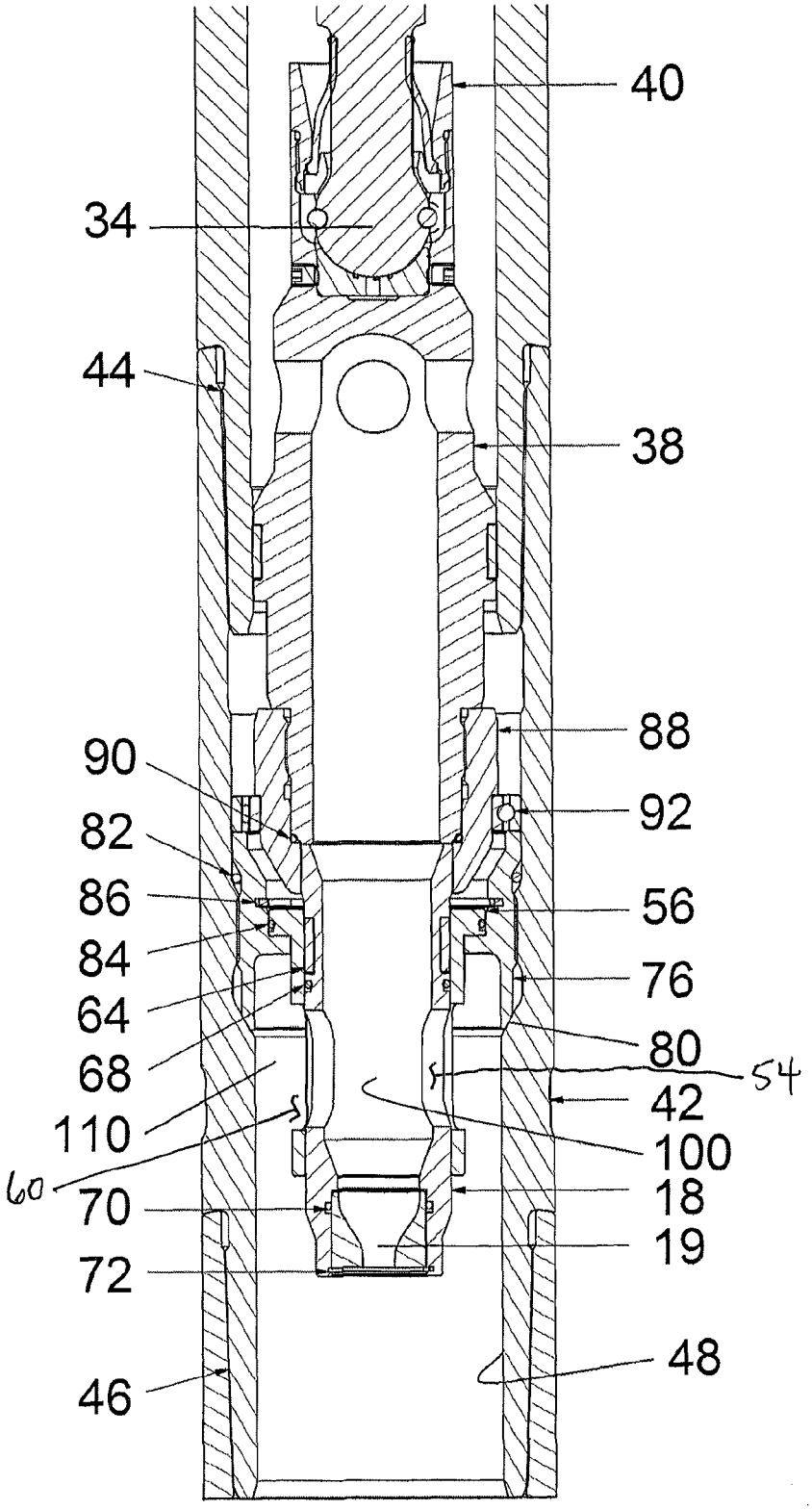
FIG. 2 is a detailed view of a portion of FIG. 1.
Figure 3:
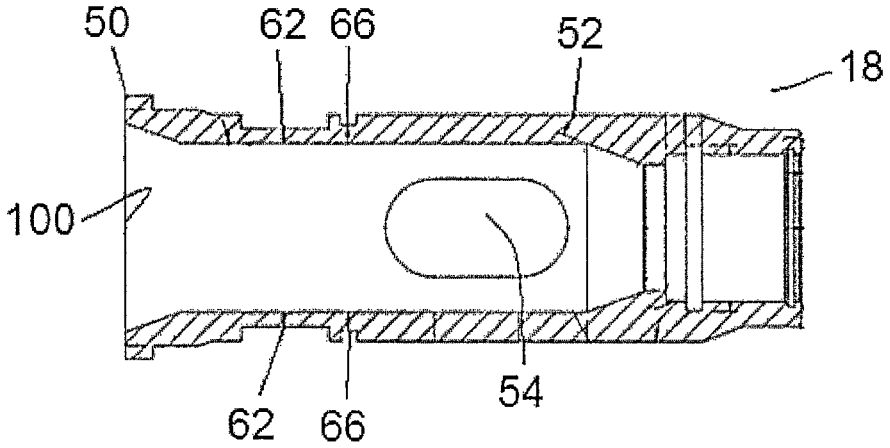
FIG. 3 shows an axial cross-sectional view of one embodiment of the nozzle holder.

The nozzle assembly comprises the nozzle holder (18) and the replaceable nozzle (19). The nozzle assembly is rotatably mounted within the central bore (48) of the sub (42). The nozzle holder (18) is adapted to attach to the drive assembly (16) at a first end (50). The nozzle holder (18) has an external bearing surface (52) which defines at least one fluid port (54), as shown in FIG. 3. In one embodiment, the fluid port (54) is elongated. In one embodiment, the external bearing surface (52) defines two fluid ports (54). In one embodiment, the fluid ports (54) are opposed. The nozzle (19) is conical-shaped and comprises an orifice or opening through which drilling fluid exits. As shown in FIG. 2, the nozzle holder (18) and nozzle (19) are configured and axially aligned to define an uninterrupted axial flow path for drilling fluid through the apparatus (10). It will be appreciated by those skilled in the art that the flow path (for example, the size) can be varied depending on the configuration of the nozzle assembly.

Figure 4:
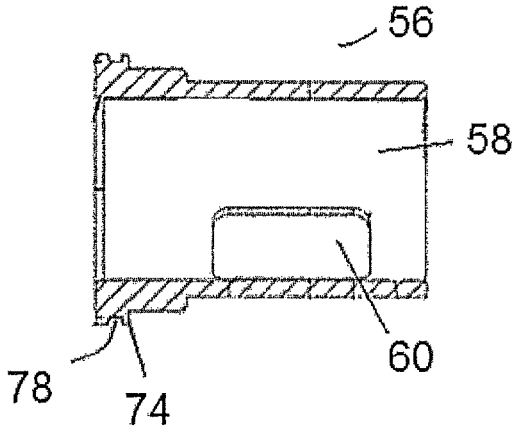
FIG. 4 shows an axial cross-sectional view of one embodiment of the nozzle housing.

The nozzle assembly rotates within a nozzle housing (56) which is mounted within the central bore (48) of the sub (42). The nozzle housing (56) has an internal bearing surface (58) defining at least one pulse opening (60) as shown in FIG. 4. In one embodiment, the pulse opening (60) is elongated. In one embodiment, the internal bearing surface (58) defines two pulse openings (60). In one embodiment, the pulse openings (60) are opposed.

The clearance between the nozzle holder (18) and the nozzle housing (56) permits easy rotation of the nozzle holder (18), while maintaining a seal. The nozzle holder (18) has at least one groove on its outer diameter for receiving at least one seal which seals the nozzle holder (18) against the nozzle housing (56). In one embodiment, the nozzle holder (18) has a first groove (62) to receive a wear ring (64). In one embodiment, the nozzle holder (18) has a second groove (66) positioned below the first groove (62) to receive an O-ring (68).

An O-ring seal (70) is provided to seal the nozzle (19). A removable retaining ring (72) secures the nozzle (19) in place.

The nozzle housing (56) defines a shoulder (74) which abuts against a cylindrical bearing support member (76) mounted within the sub (42). The nozzle housing (56) has a groove (78) to receive a seal. The bearing support member (76) is adapted to seat against a seat (80) defined by the sub (42). O-ring seals (82, 84) seal the bearing support member (76) against the sub (42), and the nozzle housing (56) against the bearing support member (76), respectively. The bearing support member (76) also defines a groove to receive a retaining ring (86) which retains the nozzle housing (56) in place.

The adapter (38) and nozzle holder (18) are secured in sealing relation by a nozzle nut (88). An O-ring seal (90) seals the adapter (38) and the nozzle holder (18) within the nozzle nut (88).

The drive shaft (30) and the nozzle holder (18) are supported by a circumferential bearing assembly (92). The bearing assembly (92) supports and centralizes the nozzle nut (88), adapter (38), and nozzle holder (18) within the sub (42). The bearing assembly (92) not only bears the radial and thrust loads imparted by the components, but also omits friction between the sub (42) and the nozzle holder (18), allowing the nozzle holder (18) to rotate smoothly about its central axis within the sub (42). In one embodiment, the bearing assembly (92) comprises a roller bearing.

The bottom sub (20) has a first end (94) to attach to the sub (42) and a second end (96) to attach to drill string (not shown) in a conventional manner. The drill bit (not shown) is attached to the drill string at a position downstream. The bottom sub (20) defines a central bore (98) through which drilling fluid may pass.

The components of the apparatus (10) can be constructed from any material or combination of materials having suitable properties such as, for example, mechanical strength, wear and corrosion resistance, and ease of machining. Suitable components may be made of carbide steel to improve wear resistance, particularly for components which are subject to turbulent drilling fluid flow, which may comprise fine solids, such as with drilling mud.

In operation, drilling fluid is pumped through the apparatus in a drilling procedure. The drilling fluid passes through the drill string (not shown), the top sub (12), the power section (14), rotating the rotor and passes around the drive shaft (30). It then enters the central bore of the adapter (38) through openings (39) and then exits through the nozzle holder (18) and the nozzle (19). The adapter openings (39) should preferably be sized to accept the flow of drilling fluid with minimal pressure drop, without adversely affecting the physical integrity of the adapter (38).

The nozzle holder (18), nozzle (19), and the nozzle housing (56) minimize the pressure loss observed, while creating an effective pulse. The restricted diameter of the nozzle (19) causes pressure buildup within the nozzle holder bore (100), as compared to the pulse chamber (110) external to the nozzle holder (18) and nozzle (19). As the fluid port (54) rotates, it periodically aligns with a pulse opening (60), allowing fluid to pulse into the pulse chamber (110). The fluid ports (54) of the nozzle holder (18) and the pulse openings (60) of the nozzle housing (56) are positioned in a radial direction to the axis of the apparatus (10) and primary direction of fluid flow. Consequently, a portion of the fluid flow is diverted from the axial to the radial direction, thereby creating a complex combination of axial and radial flow paths. The drilling fluid then continues within the drill string towards the drill bit in conventional fashion.

The amplitude of the pressure pulse created is dependent on the pressure drop across the nozzle (19). Accordingly, a nozzle (19) with a smaller opening will create a larger amplitude pulse. As well, the relative size of the fluid port (54) has some effect on the amplitude of the pulse. The frequency of the pulse is dependent on the rotational speed of the nozzle holder (18) as well as the number of fluid ports (54) and pulse openings (60). In one embodiment, there are two opposing fluid ports (54) and two opposing pulse openings (60). As a result, two pressure pulses are created for every single rotation of the nozzle (19).

In one embodiment, the two opposing fluid ports (54) and the two opposing pulse openings (60) are elongated in the axial direction, to increase the size of the aligned opening. As a result of the axially elongated fluid ports (54) and pulse openings (60), the amplitude of each pulse is increased. If the fluid ports and pulse openings were to be elongated radially, then the duration of each pulse would be extended. The configurations of the nozzle holder (18), fluid port(s) (54), pulse opening(s) (60), and nozzle (19) may be varied to achieve a desired pulse amplitude, frequency and waveform. Various combinations of fluid port(s) (54) and pulse opening(s) (60) of varying number, size and shape, together with different sizes of nozzle (19), may create varied pulse frequency, amplitudes and waveforms.

Further, the present invention provides the capability to adjust the pulse by replacing the nozzle (19). Different sizes of nozzle (19) may be used. As will be understood by those skilled in the art, the "size" of the nozzle relates to the diameter of the orifice through which drilling fluid exits. Installation or removal of the nozzle (19) is conveniently enabled by the retaining ring (72). The nozzle (19) can be readily connected or detached from the sub (42) for inspection, reinsertion or replacement as desired at the rig.

In one embodiment, the apparatus (10) is positioned below a shock tool (not shown) at a distance sufficient to avoid attenuation of the pressure pulses. An exemplary shock tool is a Mech-Thrusterm (Cougar Drilling Solutions, Edmonton, Alberta). The pressure pulses cause axial vibrations in the drill string.

As will be apparent to those skilled in the art, various modifications, adaptations and variations of the foregoing specific disclosure can be made without departing from the scope of the invention claimed herein.

What is claimed is:

1. A pressure pulse generating apparatus for use with a drill string, the apparatus having a longitudinal axis and comprising:

a) a top sub and a bottom sub for attaching the apparatus within the drill string;

b) a power section comprising a rotor and a stator;

c) a drive assembly; and d) a nozzle sub adapted to attach to the drive assembly and to house:

i) a nozzle assembly comprising a nozzle holder being rotatably mounted within the nozzle sub and having a cylindrical nozzle external bearing surface which defines at least one fluid port, and a replaceable nozzle for controlling the pressure drop across the nozzle; and ii) a nozzle housing having a cylindrical internal bearing surface, defining at least one pulse opening, which mates with the nozzle holder external bearing surface, wherein the at least one nozzle fluid port periodically aligns with the at least one pulse opening as the nozzle holder rotates within the nozzle housing, wherein the fluid ports and pulse openings are positioned in a radial direction with respect to the longitudinal axis of the apparatus and fluid flow.

2. The apparatus of claim 1, wherein the top sub is configured for coupling to the drill string at a first end and to the power section at a second end and defines a bore between the first and second ends.

3. The apparatus of claim 1, wherein the rotor and stator comprises a 1:2, 3:4, 4:5, 5:6, 7:8 or 9:10 lobe combination.

4. The apparatus of claim 1, wherein the drive assembly comprises a drive shaft having a first end coupled to the rotor and a second end coupled to the nozzle assembly.

5. The apparatus of claim 4, wherein the drive shaft is coupled and sealed to the rotor, and to the nozzle assembly using upper and lower adapters.

6. The apparatus of claim 5, wherein the lower adapter and the nozzle holder are secured in sealing relation by a nozzle nut.

7. The apparatus of claim 6, further comprising a seal for sealing the lower adapter and the nozzle holder within the nozzle nut.

8. The apparatus of claim 1, wherein the nozzle sub has a first end adapted to attach to the drive assembly, a second end adapted to attach to the bottom sub, and a central bore extending between the first and second ends.

9. The apparatus of claim 1, wherein the bottom sub has a first end to attach to the nozzle sub, a second end to attach to the drill string, and a central bore extending between the first and second ends.

10. The apparatus of claim 1, wherein the nozzle holder and nozzle are axially aligned to define an uninterrupted flow path for drilling fluid therethrough.

11. The apparatus of claim 1, wherein the nozzle is conical-shaped.

12. The apparatus of claim 1, wherein the nozzle holder comprises at least one groove on its outer diameter for receiving at least one seal for sealing the nozzle holder against the nozzle housing.

13. The apparatus of claim 1, wherein the nozzle housing defines a shoulder adapted to abut a cylindrical bearing support member mounted within the nozzle sub.

14. The apparatus of claim 13, wherein the nozzle housing comprises a groove for receiving a seal.

15. The apparatus of claim 1, further comprising a removable retaining ring for securing the nozzle.

16. The apparatus of claim 1, wherein the fluid ports and pulse openings are elongated axially.

17. The apparatus of claim 16, wherein there are two opposed nozzle fluid ports.

18. The apparatus of claim 16, wherein there are two opposed pulse openings.

19. The apparatus of claim 1, further comprising a circumferential bearing assembly for supporting the drive assembly and the nozzle holder.

20. The apparatus of claim 19, wherein the bearing assembly comprises a roller bearing.

21. A method of axially vibrating a drill string, comprising the step of inserting the apparatus of claim 1 in the drill string, pumping drilling fluid through the drill string and creating pressure pulse waves of a desired frequency, amplitude and waveform.

22. The method of claim 21, wherein creating pressure pulse waves of the desired frequency, amplitude and waveform comprises varying the number, size or shape of the fluid ports and pulse openings, or the size of the nozzle.

23. A pressure pulse generating apparatus for use with a drill string, the apparatus comprising:

a) a top sub and a bottom sub for attaching the apparatus within the drill string;

b) a power section comprising a rotor and a stator;

c) a drive assembly; and d) a nozzle sub adapted to attach to the drive assembly and to house:

i) a nozzle assembly comprising a nozzle holder being rotatably mounted within the nozzle sub and having a cylindrical nozzle external bearing surface which defines at least one fluid port, and a replaceable nozzle for controlling the pressure drop across the nozzle; and ii) a nozzle housing having a cylindrical internal bearing surface, defining at least one pulse opening, which mates with the nozzle holder external bearing surface, wherein the at least one nozzle fluid port periodically aligns with the at least one pulse opening as the nozzle holder rotates within the nozzle housing;

iii) wherein the nozzle holder comprises at least one groove on its outer diameter for receiving at least one seal for sealing the nozzle holder against the nozzle housing.

24. A pressure pulse generating apparatus for use with a drill string, the apparatus comprising:

a) a top sub and a bottom sub for attaching the apparatus within the drill string;

b) a power section comprising a rotor and a stator;

c) a drive assembly; and d) a nozzle sub adapted to attach to the drive assembly and to house:

i) a nozzle assembly comprising a nozzle holder being rotatably mounted within the nozzle sub and having a cylindrical nozzle external bearing surface which defines at least one fluid port, and a replaceable nozzle for controlling the pressure drop across the nozzle; and ii) a nozzle housing having a cylindrical internal bearing surface, defining at least one pulse opening, which mates with the nozzle holder external bearing surface, wherein the at least one nozzle fluid port periodically aligns with the at least one pulse opening as the nozzle holder rotates within the nozzle housing;

(e) wherein the drive assembly comprises a drive shaft having a first end coupled and sealed to the rotor with an upper adapter and a second end coupled and sealed to the nozzle holder with a lower adapter, and wherein the lower adapter and the nozzle holder are secured in sealing relation by a nozzle nut.

* * * * *